United States Patent [19]

Williams et al.

[11] 4,069,466

[45] Jan. 17, 1978

[54] VARIABLE RESISTANCE ELECTRICAL CONTROL UNITS

[75] Inventors: Charles Norman Williams, Solihull; Hugh Roberts, Whalley near Blackburn, both of England

[73] Assignee: R. & D. Instruments Limited, Ramsey, England

[21] Appl. No.: 678,232

[22] Filed: Apr. 19, 1976

[30] Foreign Application Priority Data

Apr. 19, 1975 United Kingdom ..... 16257/75

[51] Int. Cl.[2] ..... H01C 10/24

[52] U.S. Cl. ..... 338/147; 338/167; 338/202

[58] Field of Search ..... 338/147, 118, 157, 160, 338/162, 167, 190, 202; 200/277, 278, 279

[56] References Cited

U.S. PATENT DOCUMENTS

| | | | |
|---|---|---|---|
| 1,785,779 | 12/1930 | Lauter | 338/157 X |
| 2,542,113 | 2/1951 | Bowitz et al. | 338/147 |
| 2,712,584 | 7/1955 | Pantages | 338/147 X |
| 2,745,915 | 5/1956 | Pantages | 338/147 X |

*Primary Examiner*—C. L. Albritton

*Attorney, Agent, or Firm*—Andrus, Scaeles, Starke & Sawall

[57] ABSTRACT

An electrical control unit operable as a rheostat or a potentiometer comprising an electrical circuit portion of a resistive electrically conducting material formed on a support in a spiral configuration, a spindle mounted for rotation about the center of the spiral, an arm non-rotatably engaged on the spindle but slidable relatively to the spindle radially with respect to the axis thereof, an electrical contact carried on the arm to move radially therewith, to make contact with said circuit portion, and a spiral guide means aligned with the circuit portion spiral and co-operable with the arm to guide said arm radially, so that the electrical contact follows the circuit portion spiral to alter the effective electrical resistance thereof in use.

7 Claims, 4 Drawing Figures

VARIABLE RESISTANCE ELECTRICAL CONTROL UNITS

This invention relates to electrical control units of the kind providing variable electrical resistance and in which there is provision for continuous variation of that resistance between predetermined limits.

It has already been proposed to provide a control unit in which electrical resistive material, on a support, is arranged in a spiral, the unit having an angularly movable arm centred on the axis of the spiral and the arm carrying an electrical contact which moves radially on the arm and is guided to follow the spiral by means of a spiral track which is opposed to and correspondingly arranged with respect to the spiral of the resistive material. The use of a radially moving contact however, is not satisfactory because the forces acting tend to make the contact jam so that adjustment can no longer be achieved.

It is the object of the invention to provide such a unit in a convenient, compact and effective form and which may be of high rating and in which operation is reliable.

According to the present invention an electrical control unit comprises an electrical circuit portion of a resistive electrically conducting material formed on a support in a spiral configuration, a spindle mounted for rotation about the centre of the spiral, an arm non-rotatably engaged on the spindle but slidable relatively to the spindle radially with respect to the axis thereof, an electrical contact carried on the arm to move radially therewith, to make contact with said circuit portion, and a spiral guide means aligned with the circuit portion spiral and co-operable with the arm to guide said arm radially, so that the electrical contact follows the circuit portion spiral to alter the effective electrical resistance thereof in use.

The invention will now be described by way of example with reference to the accompanying drawings in which, FIG. 1 is a plan view of an electrical control unit constructed in accordance with the invention, with the top of the casing removed.

Figure 3:
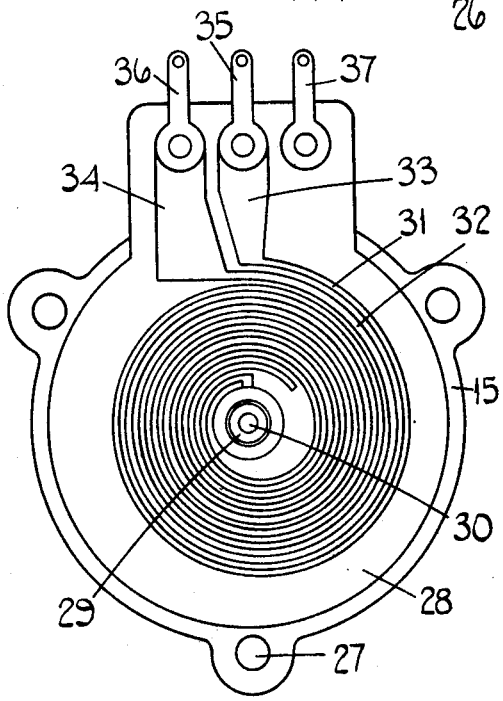
FIG. 3 is a view of the inside of the cover showing the electrical circuit portion and, FIG. 4 is a cross-sectional view of the arm.

The unit shown in the drawings is continuously variable between extremes of electrical resistance. The unit comprises a shallow cylindrical plastics housing 10 which is open at one end and provided with a spigoted integral wall at the other. In the centre of the spigoted end wall is journalled a spindle 11. On the outside the spigot is screw threaded at 12 and carries a nut 13, whereby the unit may, for example, be fixed in a panel. One end of the spindle 11 extends out of the spigoted end and is capable of accepting a control knob. There are three lugs having holes 14 to accept screws for securing a cover 15 which is shown in FIG. 3.

The other end of the spindle extends into the shallow cylindrical interior of the housing 10. In the interior flat end wall of this housing is a spiral groove 16. The beginning and end of the grooves 16 are, in the example, though not necessarily, radially aligned as shown in FIG. 1.

Figure 4:
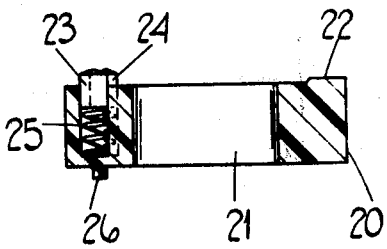

The end of the spindle 11 extending into the housing interior has a small diameter portion 17. Adjacent to this is a portion having a pair of opposite flats 18. Next to this in turn is a flange 19. Slidably engaged on the portion 18 of the spindle having the flats is an arm 20, which is also shown in FIG. 4. This arm, of electrical insulating material, is formed with a closed ended through slot 21. The slot 21 is of a width to engage slidably on the flatted portion 18 of the spindle, and that it will rotate with the spindle.

The arm 20 has, at one end, an integral low projection 22, this being beyond the end of the slot. The other end of the arm 20 has two interconnected blind bores which extend substantially parallel to the axis of the spindle. The bores contain respective metal plungers 23, 24 which are backed by respective coils of double spring 25. Connecting the coils of this spring is a portion which extends through the slot which connects the two bores. The bores are at different distances from the end of the arm so that as the arm moves with the spindle, the plungers follow paths of different radial distances from the axis of the spindle. On the opposite side of the arm from that at which the two plungers 23, 24 extend is an integral peg 26. This engages in the spiral groove 16.

Figure 1:
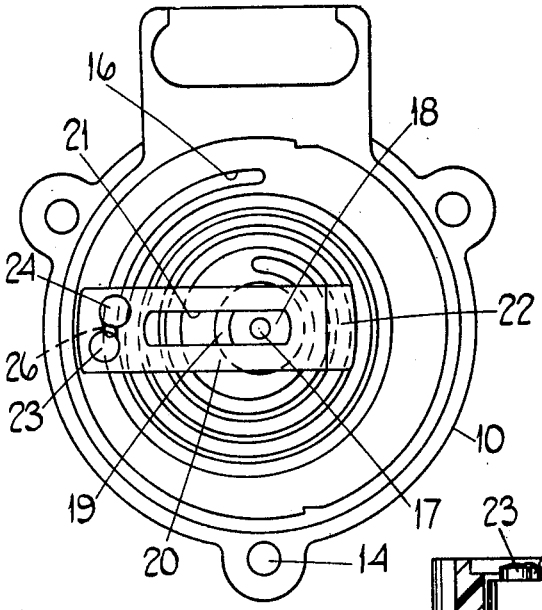
Figure 2:
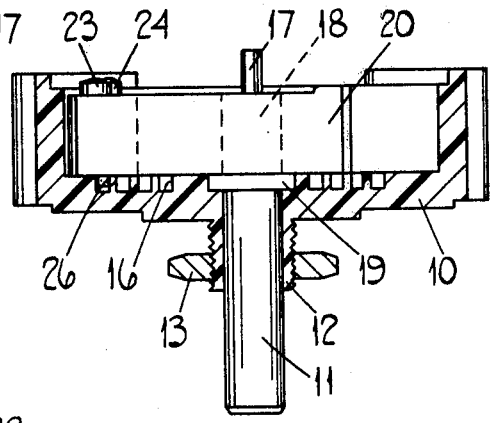
FIG. 2 is a cross-sectional side view of the electrical control unit.

Closing the open end of the housing 10 is the flat circular plastics cover 15 which is omitted from FIG. 1 for clarity. The cover 15 has lugs having holes 27 aligned with the holes 14 of the housing to accept screws for fixing the cover to the housing 10. There is fixed on the cover a plate 28 retained by a hollow rivet 29, through the centre of which is a spigot 30 on the cover 15 having a central hole for the cylindrical end 17 of the spindle 11. The plate 28 is made of metal with an insulating layer, on the surface of which are printed electrically conductive circuit portions, 31, 32 the shape of which are spirals, a mean line of which corresponds and is aligned with the spiral groove 16 in the oppositely presented face of the end wall of the housing 10. The pattern of the circuit portions are, in this example formed by applying a thin sheet of electrically conducting resistive foil onto the surface of the plate 28 and removing the sufficient of this to define the circuit portions, by etching or other process. Other means such as printing may be used to form the plate which may be of electrically insulating material.

Electrical connections 33, 34, are provided at the outer ends of both spirals 31, 32 respectively. These extend into an extension of the cover 15 and plate 28 and terminate in externally accessible terminals 35, 36. A third terminal 37 is connected to the plate 28. One of the spirals connects, at the centre of the plate 28, to the hollow rivet 29.

Rotation of the spinde 11 causes the arm with the two plungers 23, 24, to rotate also. The arm is constrained to move both angularly and radially, under the guidance of the pin 26, running in the groove 16.

If connection is made to an external voltage supply by means of the terminals 35 and 36 only, the unit operates in the variable current mode, that is, as a rheostat. The plungers 23, 24 are used as shorting elements to connect, in series, the two portions of the resistive spirals between the terminal 35 and plunger 23, and the terminal 36 and plunger 24 respectively. The further the plungers 23 and 24 are inwardly spaced from the two connections 33, 34, the greater is the resistance between these connections.

If an electrical potential difference is applied across the terminals 36, 37, however, then the spiral 32 acts as a potentiometer wire having a uniform fall of potential along its length. The plunger 24 receives from the spiral 32 an electric potential in the same proportion to the applied potential between the terminals 36, 37 as the distance of the plunger 24 from the terminal 36 is to the entire length of the spiral 32. This potential is fed from the plunger 24 via the double spring 25 and plunger 23 to the spiral 33 and thence to the terminal 35. This proportion of the total potential applied between the terminals 36, 37 is greater the further the plungers 23, and 24 are inwardly spaced from the terminals. The unit here operates in the variable voltage mode, that is, as a potentiometer.

The resistance of one of the spirals may be reduced as compared with the other by using a wider strip of foil.

Single, double or multiple tracks may be provided to form devices with varying purposes including electrical potentiometers, rheostats or other devices. A metal arm with contact for taking off at any point may be provided.

In another example, a fixed resistor may be provided for connection in series with the spiral, these being connected through a rivet or eyelet, and the fixed resistor being on the reverse side of the plate 28. This provides a fine adjustment for resistance variation in a potentiometer.

Within the same body structure, single or multiple turns may be provided by varying the number of spiral turns of the plated resistor and by varying the length of the slotted arm.

In a further alternative construction the slotted arm 20, is replaced by a solid arm with flat sides. It is slidably engaged in a slot formed diametrically in the spindle.

We claim:

1. An electrical control unit, comprising an electrical circuit portion of a resistive electrically conducting material formed on a support in a spiral configuration, a spindle mounted for rotation about the centre of the spiral and having a non-circular portion, an arm having a longitudinally extending slot non-rotatably engaged on the non-circular portion of the spindle to provide for sliding movement of the arm relative to the spindle and radially with respect to the axis thereof, an electrical contact carried on the arm to move radially therewith, to make contact with said circuit portion, and a spiral guide means aligned with the circuit portion spiral and co-operable with the arm to guide said arm radially so that the electrical contact follows the circuit portion spiral to alter the effective electrical resistance thereof in use.

2. An electrical control unit as set forth in claim 1 wherein the support comprises a casing in which the spindle is journalled, said casing having opposed surfaces interiorly generally normal to said spindle, said electrical circuit portion being mounted on one of said opposed surfaces, a spiral track being provided on the other of the opposed surfaces, said arm being engagable with the track and movable in said casing to move the electrical contact correspondingly over the electrical circuit portion.

3. An electrical control unit as claimed in claim 1 in which the contact comprises two electrically interconnected contact plungers engageable with respective zones of said circuit portion to form a conducting bridge between them.

4. An electrical control unit as claimed in claim 2 in which the circuit portion has connections mounted in the casing and accessible for connection to external circuits.

5. An electrical control unit as claimed in claim 1 in which the spiral track is a groove and the arm is co-operable therewith through a peg on the arm.

6. An electrical control unit as claimed in claim 5 in which the peg is on one end of the arm, at which the electrical contact is also mounted.

7. An electrical control unit as claimed in claim 1 in which the material of the circuit portion is plated or otherwise applied to an electrically insulated support.

* * * * *